US008388470B2

(12) United States Patent
Canosa et al.

(10) Patent No.: US 8,388,470 B2
(45) Date of Patent: Mar. 5, 2013

(54) PITCHING AND HITTING TRAINING AID

(76) Inventors: Marshall Joseph Canosa, Pine Bush, NY (US); William Patrick Fraser, Hopewell Junction, NY (US); James Henry Telgheder, Slate Hill, NY (US)

( * ) Notice: Subject to any disclaimer, the term of this patent is extended or adjusted under 35 U.S.C. 154(b) by 307 days.

(21) Appl. No.: 12/938,674

(22) Filed: Nov. 3, 2010

(65) Prior Publication Data

US 2011/0105252 A1 May 5, 2011

Related U.S. Application Data

(60) Provisional application No. 61/257,509, filed on Nov. 3, 2009.

(51) Int. Cl.
*A63B 69/00* (2006.01)

(52) U.S. Cl. ..... 473/452; 473/266; 340/573.1

(58) Field of Classification Search ..... 473/266–270, 473/451–455; 434/252; 340/541, 573.1, 340/573.3
See application file for complete search history.

(56) References Cited

U.S. PATENT DOCUMENTS 3,776,555 A * 12/1973 Hagaman ..... 473/221
4,563,005 A * 1/1986 Hand et al. ..... 473/455
4,577,863 A * 3/1986 Ito et al. ..... 473/453
4,903,968 A * 2/1990 Hargrave ..... 473/220
5,023,597 A * 6/1991 Salisbury ..... 340/573.4
5,087,047 A * 2/1992 McConnell ..... 473/221
5,509,649 A * 4/1996 Buhrkuhl ..... 473/455
6,118,375 A * 9/2000 Duncan ..... 340/541
6,261,189 B1 * 7/2001 Saville et al. ..... 473/221
6,685,480 B2 * 2/2004 Nishimoto et al. ..... 434/247
7,666,118 B1 * 2/2010 Anthony ..... 482/8
7,704,153 B2 * 4/2010 Loh et al. ..... 473/221
7,782,199 B2 * 8/2010 Issokson ..... 340/541
7,959,528 B1 * 6/2011 Wilkes et al. ..... 473/453
2004/0162154 A1 * 8/2004 DeJohn ..... 473/266
2005/0215335 A1 * 9/2005 Marquardt ..... 473/131
2005/0255945 A1 * 11/2005 Green ..... 473/417
2007/0207873 A1 * 9/2007 Rose ..... 473/207
2008/0182686 A1 * 7/2008 Kellogg ..... 473/451
2010/0248853 A1 * 9/2010 Dellinger ..... 473/225
2010/0304876 A1 * 12/2010 Hohla et al. ..... 473/199

* cited by examiner

*Primary Examiner* — Mark Graham

(57) ABSTRACT

A training device for detecting improper or proper form for batting and pitching. The present invention makes use of two sensors that will detect the positioning of the user during the pitching or batting motion. The invention helps detect whether the user is "lunging" or "rushing" and encourages users to keep their upper body back during the motion of pitching or batting. The present invention can also be used for other sports that require users to perform similar body mechanics.

20 Claims, 6 Drawing Sheets

PITCHING AND HITTING TRAINING AID

The current application claims a priority to the U.S. Provisional Patent application Ser. No. 61/257,509 filed on Nov. 3, 2009.

FIELD OF THE INVENTION

The present invention relates generally to a baseball pitching and hitting training aid device using auditory and visual prompts to measure proper technique while pitching or hitting.

SUMMARY OF THE INVENTION

The present invention identifies improper/proper pitching and hitting mechanics in the game of baseball by using audible/visual sensors to alert a participant or instructor. The present invention can also be used to detect the form and mechanics of a user's golf swing. The device will solve the problem of the participant going too fast to home plate during his/her pitching motion. This action of moving towards the home plate is called "rushing". Similarly the device will solve the problem of the hitter stepping too fast toward the pitcher as the ball is being thrown toward home plate. This action of moving towards the pitcher too fast is called "lunging". The audible/visual sensors are set at two different heights. One sensor is focused on the user's waist area, and the other sensor is focused on his lower lead leg area. The two sensors will activate in sequence when the pitcher or hitter goes through his/her entire pitching or hitting motion. The sensors will possess different sounds or different sounds and different visual indicators. The lead foot of the participant and the hip area of the participant pass through their respective sensor fields. If the lead foot activates the lower sensor first and the hip area activates the upper sensor second, the device has shown that the participant has properly activated the device. With a distinct discernable time between the activation of the lower sensor and the upper sensor, the user has performed the pitching or batting motion with proper mechanics. If the activation of the sensors happens in any other fashion, it will show improper mechanics. Keeping the weight of the participant in the proper starting position, and then transferring the weight from back to front sequentially is an important fact that must be adhered to in order to maximize the potential of the participant performing the pitching or hitting skill. With two sensors and two different sounds, the participant and his/her instructor will have immediate feedback to the proper sequence. It can be used in a pitching or hitting application. I have never seen or heard of any baseball device that measures pitching or hitting in this fashion. This device is portable, easy to use, easy to set up, will use batteries, and can be used indoors or outdoors by one person.

DETAIL DESCRIPTIONS OF THE INVENTION

Figure 1:
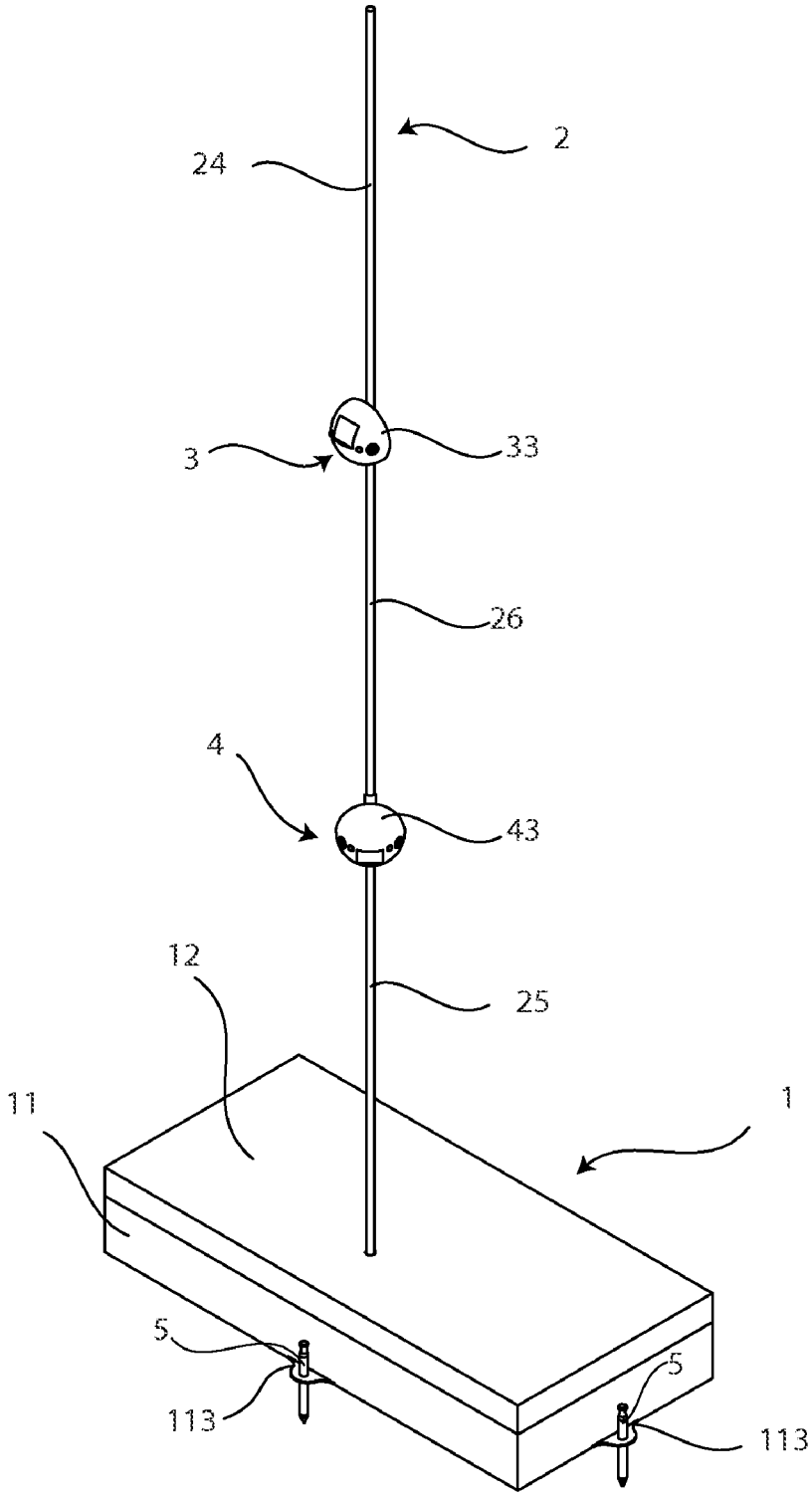
FIG. 1 is a perspective view of the assembled present invention with the mount case in a closed position.

All illustrations of the drawings are for the purpose of describing selected versions of the present invention and are not intended to limit the scope of the present invention.

The present invention is a batting and pitching training device that focuses on helping users to develop proper form during batting and pitching. In reference to FIG. 1-3, the present invention is a training aid that comprises of a mount case 1, a mount pole 2, a top sensor 3, and a bottom sensor 4. The mount case 1 is used as a holding base that is able to stand the mount pole 2 up. The top sensor 3 and the bottom sensor 4 are connected to the mount pole 2 at differing heights for the sensing of a user's form when batting or pitching a baseball.

In reference to FIG. 1-4, the mount pole 2 is the structure of the present invention that holds the top sensor 3 and the bottom sensor 4 for detecting the posture and form of the user when practicing batting or pitching. The mount pole 2 comprises of a first segment collar 22, a second segment collar 23, a top segment 24, a bottom segment 25, a middle segment 26, a top sensor mount 27, and a bottom sensor mount 28. The mount pole 2 is broken into the top segment 24, the middle segment 26, and the bottom segment 25 to provide the mount pole 2 the ability to be taken apart for easy storage and portability. The top segment 24 has a first top end 241 and a first bottom end 242. The middle segment 26 has a second top end 261 and a second bottom end 262. The bottom segment 25 has a third top end 251 and a third bottom end 252. To connect the three segments, each of the segments has a fastening means. The first bottom end 242 has a top fastening means 211. The second bottom end 262 has a middle fastening means 213. The third bottom end 252 has a bottom fastening means 212. The top fastening means 211, the middle fastening means 213, and the bottom fastening means 212 can be fasteners selected from the group consisting of threads, snap-on lips, clamp, latches, or any other suitable fastening method. The first segment collar 22 and the second segment collar 23 are tube shaped collars which are the supports that hold the segments together. The first segment collar 22 is positioned and secured about the circumference of the middle segment 26 adjacent to the second top end 261. The first segment collar 22 comprises of a top segment receiver 221. The first segment collar 22 extends past the second top end 261 and leaves an open cavity that is able to receive the top segment 24. The second segment collar 23 comprises of a middle segment receiver 231. The second segment collar 23 is positioned and secured about the circumference of the bottom segment 25 adjacent to the third top end 251. The second segment collar 23 extends past the third top end 251 and leaves an open cavity that is able to receive the middle segment 26. The top segment receiver 221 and the middle segment receiver 231 can be female fastener parts selected from the group consisting of threads, clamps, latches, or any other suitable female fastener parts. In reference to FIG. 2, when assembling the mount pole 2 for practicing hitting or batting, the user is able to easily take the top segment 24 and secure it to the middle segment 26 in a linear relationship by inserting the first bottom end 242 and the top fastening means 211 of the top segment 24 into the top segment receiver 221 of the first segment collar 22. In a similar fashion, the user can take the middle segment 26 and secure it to the bottom segment 25 in a linear relationship by inserting the second bottom end 262 and the middle fastening means 213 of the middle segment 26 into the middle segment receiver 231 of the second segment collar 23. In other embodiments of the present invention, the top segment 24, the middle segment 26, and the bottom segment 25 can be poles of any shapes with any length including triangles, squares, or hexagons.

Figure 3:
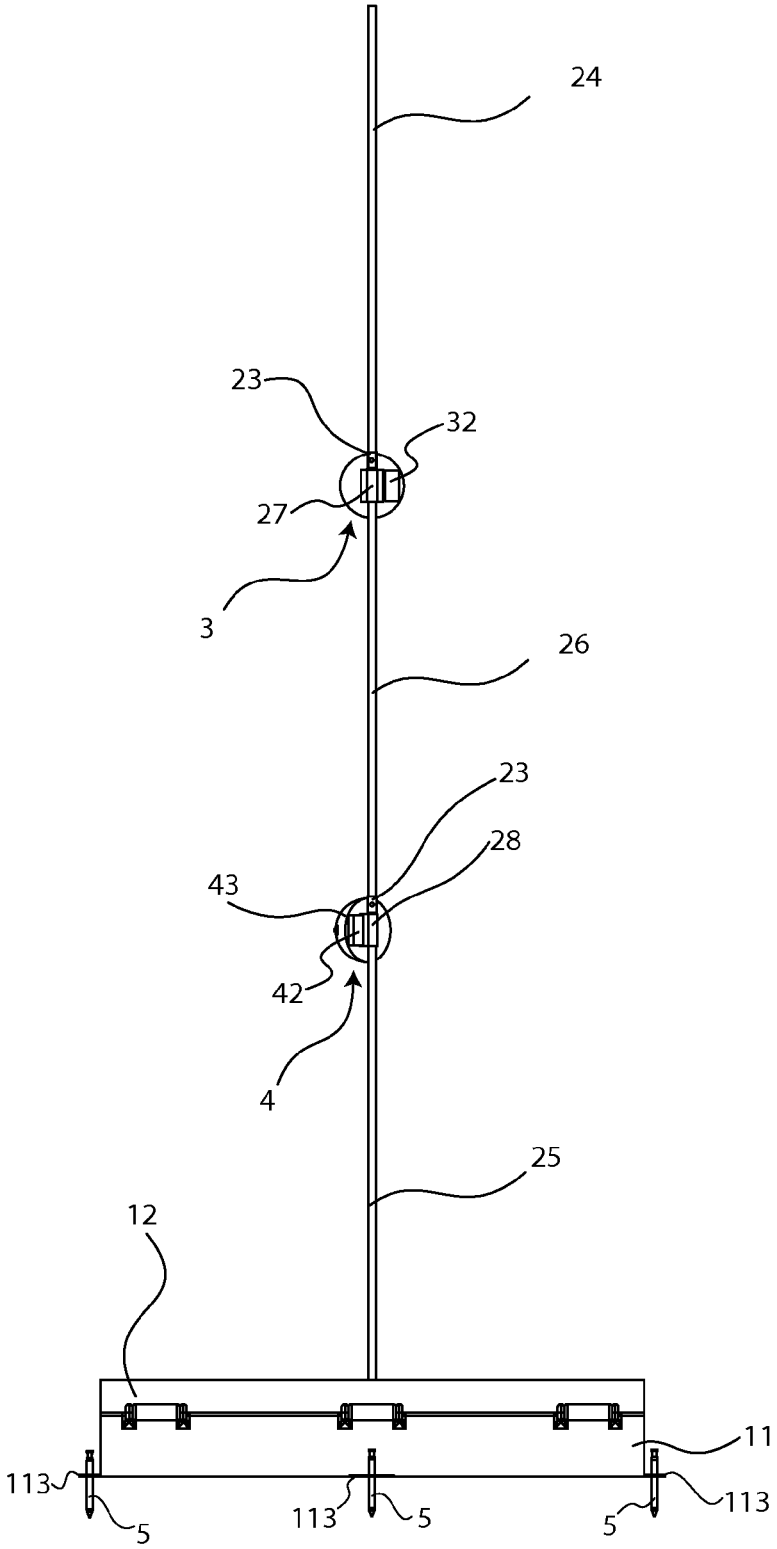
FIG. 3 is a rear elevational view of the assembled present invention with the mount case in a closed position.
Figure 5:
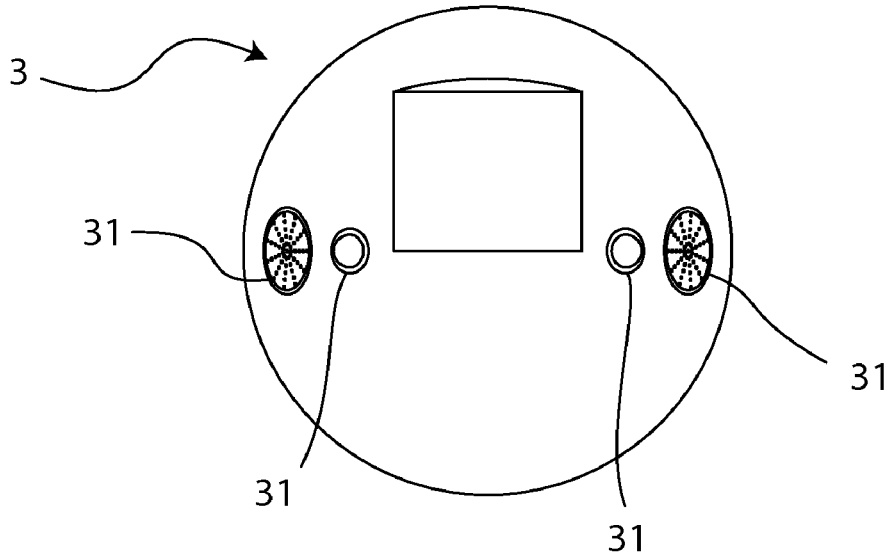
FIG. 5 is a front elevational view of the top sensor with the embodiment using both the visual and audio indicators. The indicators shown are lights that can flash and small speaker that will emit a sound when the top sensor is activated.
Figure 6:
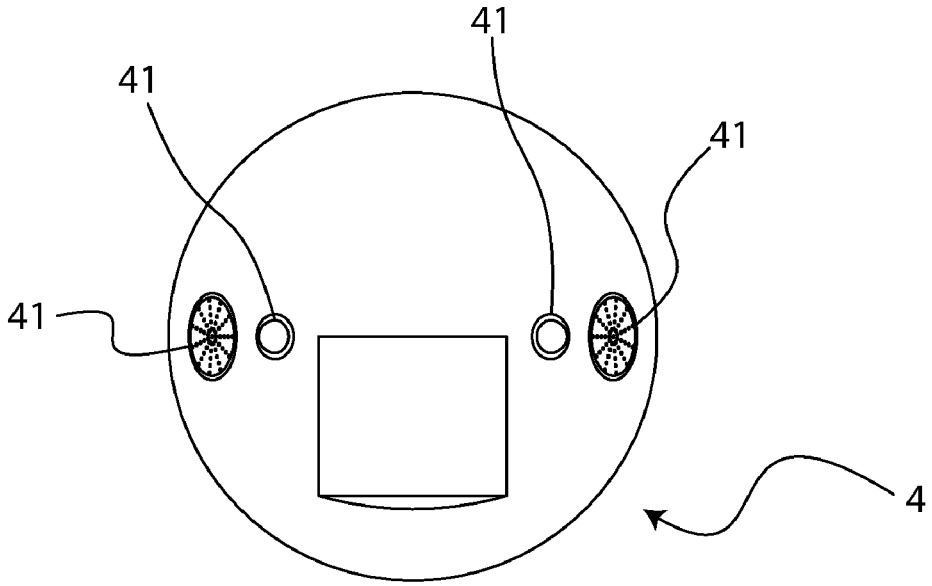
FIG. 6 is a front elevational view of the bottom sensor with the embodiment using both the visual and audio indicators. The indicators shown are lights that can flash and small speaker that will emit a sound when the bottom sensor is activated.

In reference to FIG. 3 and FIG. 5-6, the top sensor 3 and the bottom sensor 4 are mounted onto the mount pole 2 by means of the top sensor mount 27 and the bottom sensor mount 28. In the preferred embodiment of the present invention, the top sensor mount 27 is fastened to the middle segment 26 adjacent to the first segment collar 22. The bottom sensor mount 28 is fastened to the bottom segment 25 adjacent to the second segment collar 23. However, in other embodiments of the present invention, the top sensor mount 27 and the bottom sensor mount 28 can be adjusted and fastened to any other position on the mount pole 2 to accommodate to users of different heights. This can be done by loosening the fasteners of the top sensor mount 27 and the bottom sensor mount 28 and sliding the two mounts to any positioned as desired by the user. In other embodiments of the present invention, the top sensor mount 27 and the bottom sensor mount 28 can be adjusted along the length of the mount pole 2 by other means. The other means of adjustment can include the mount pole 2 having calibrated holes, notches, or other set points to allow for calibration of the top sensor 3 and the bottom sensor 4 to be adjusted to correspond to a user's height. The top mount can be fastened to the mount pole 2 by other means such as a sliding bracket with a pin, a Velcro wrap, a clamp, a sliding bracket with ball bearings, or any other suitable methods.

Figure 4:
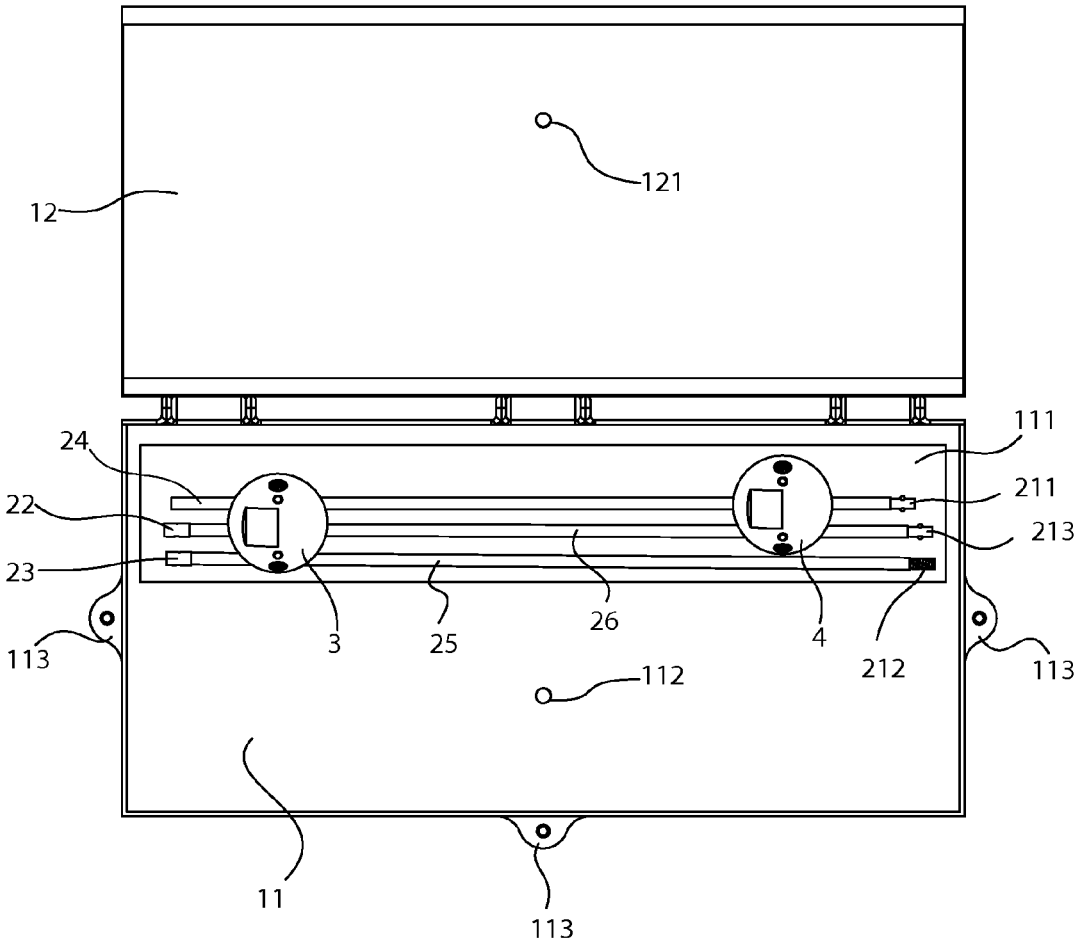
FIG. 4 is a top plan view of the mount pole collapsed and stored in the storage compartment of the mount case. The mount case is shown in an open position.
Figure 7:
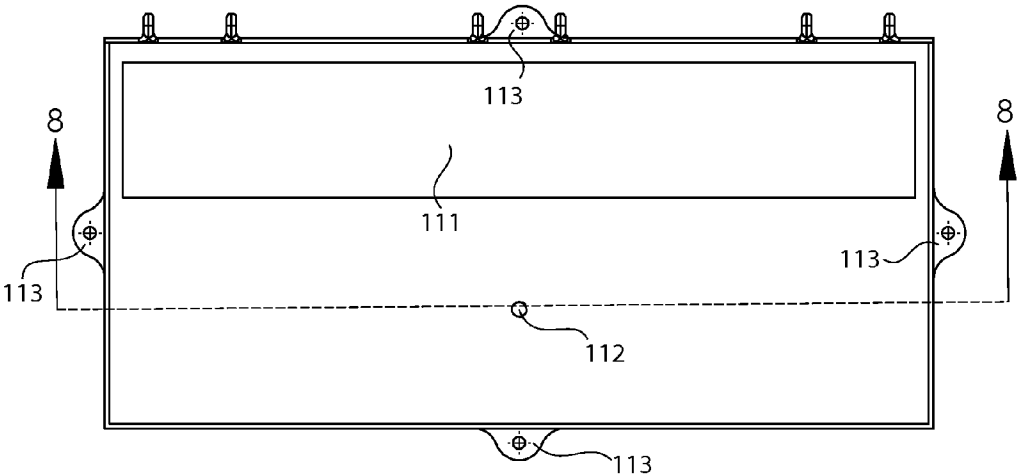
FIG. 7 is a top plan view of the base of the present invention showing a plane upon which is taken and shown FIG. 8.
Figure 8:
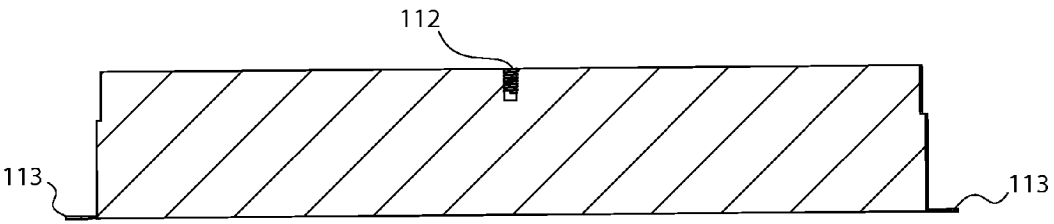
FIG. 8 is front elevational view showing the cross section of the base of the present invention.

In reference to FIG. 4 and FIG. 7-8, the mount case 1 comprises of a base 11 and a cover 12. The base 11 is main body that provides stability to the mount case 1. The base 11 comprises of a storage compartment 111, a pole port 112, and a plurality of eyelets 113. The storage compartment 111 is a recessed space on the base 11 that is sized to be able fit the collapsed mount pole 2. The storage compartment 111 allows the mount case 1 to act as a carrying case for the present invention when not in use. The pole port 112 is a recessed hole that is centered on the base 11 and is shaped to fit the mount pole 2. The cover 12 is used to enclose the collapsed mount pole 2 inside the mount case 1 when not in use. The plurality of eyelets 113 is protruding portion from the bottom of the base with a hole. The plurality of eyelets 113 allows the user to secure the mounting case to the ground with a plurality of stakes 5. The cover 12 is jointly attached to the base 11 and can be arranged in an open position or a close position to expose or enclose the storage compartment 111. However, when the present invention is in use and the cover 12 is in a close position, the cover 12 comprises of pole port hole 121. The pole port hole 121 is a hole that is centered on the cover 12 that will lead into the pole port 112 when in a closed position. The pole port hole 121 similar to the pole port 112 is shaped to fit the mount pole 2. The mount case 1 optionally comprises of a latch that will allow the cover 12 to secure to the base 11 when in a closed position.

In reference to FIG. 3, the top sensor 3 and the bottom sensor 4 is connected to the mount pole 2 by means of the top sensor mount 27 and the bottom sensor mount 28, respectively. The top sensor 3 comprises of a top protective casing 33, a top activation indicator 31 and a top battery pack 32. The bottom sensor 4 comprises of a bottom protective casing 43, a bottom activation indicator 41 and a bottom battery pack 42. The top sensor 3 and the bottom sensor 4 can be any type of proximity sensors including ultrasonic sensors, optical sensors, photoelectric sensors, infrared sensors, thermal sensors, or any other suitable sensors that are able to detect presence linearly. The top sensor 3 and the bottom sensor 4 are wrapped with the top protective casing 33 and the bottom protective casing 43, respectively. The top protective casing 33 and the bottom protective casing 43 have holes to reveal the sensors and the indicators. The top protective casing 33 and the bottom protective casing 43 can be made from the dense materials that are able to absorb shock such as memory foam, sponges, polyurethane foam, rubber, or any other suitable materials able to absorb impact. The top sensor 3 and the bottom sensor 4 are powered by the top battery pack 32 and the bottom battery pack 42, respectively. Both the top sensor 3 and the bottom sensor 4 are arranged to be facing the same direction with the line of sight being parallel with respect to each other. Both the top sensor 3 and bottom sensor 4 are arranged so that the top sensor is arranged parallel to the user and perpendicular to the ground and the bottom sensor faces the user at a 45 degree angle and perpendicular to the ground. When the top sensor 3 is activated, the top activation indicator 31 will indicate the sensing of presence. When the bottom sensor 4 is activated, the bottom activation indicator 41 will indicate the sensing of presence. The type of indication that the top activation indicator 31 and the bottom activation indicator 41 is able to make can be either audio or audio and visual. In the preferred embodiment of the present invention, the indication provided is both audio and visual. In the embodiment of the present invention where the indication of sensed presence is visual, the top sensor 3 and the bottom sensor 4 will have any types of lights or other illumination methods emitting a green light. In the embodiment of the present invention where the indication of sensed presence is audio, the top sensor 3 and the bottom sensor 4 will each have a speaker to emit sound. The indication by the top sensor 3 and the bottom sensor 4 are to be different whether the indication type is audio or visual. For example, if the indication type is both visual and audio, the top sensor 3 can emit a red light and a high pitch sound while the bottom sensor 4 emits a green light and a low pitch sound. If the indication type is audio, the top sensor 3 can emit a sound with a frequency that is higher than that of the sound emitted by the bottom sensor 4. In other embodiments of the present invention, the top activation indicator 31 and the bottom activation indicator 41 can be wireless signals that can be received by a computing system. The computing system can time the difference in time between the receiving of the signal from the top sensor 3 compared to the bottom sensor 4, or vice versa.

Figure 2:
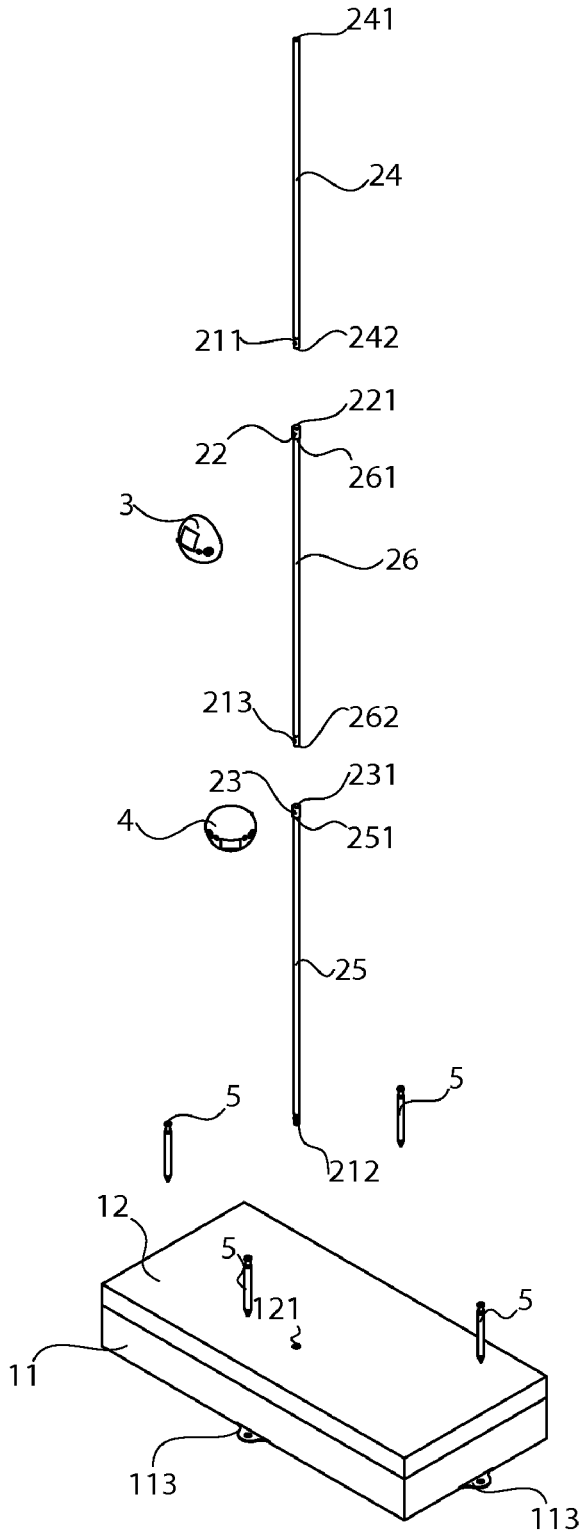
FIG. 2 is an explosion view of the present invention.

In reference to FIG. 1 and FIG. 8, to complete the assembly of the present invention, the bottom segment 25 is fastened through the pole port hole 121 into the pole port 112 of the base 11. The pole port can be a female fastening part selected from the group consisting of threads, snap-on indentations, clamps, latches or any other suitable fasteners. To secure the mount pole 2 to the mount case 1 in an upright position, the bottom fastening means of the bottom segment is fastened into the pole port. To achieve the optimum results for detecting form, the present invention must be set up with the top sensor 3 directed towards the user's hip area under the lower ribs and with the bottom sensor 4 directed towards the user's knee level. To use the present invention for the batting practice, the present invention will be placed in front of the user with the top sensor 3 and the bottom sensor 4 directed towards the front of the user's body. The present invention is positioned to have the direction of the top and bottom sensor 4 to be perpendicular to the front plane of the user's body and the direction of the user's stride. The top sensor 3 and the bottom sensor 4 are placed ahead of the body where the user will take the stride to perform the batting action. While the user is performing a stride and the batting action, the user will first stride forward with their lead leg with their upper body following forwards afterward. To use the present invention for the pitching training, the present invention will be placed to the side of a mound facing the user or the side of the mound facing the users back during the ready position. However, similar to the use of the present invention for batting practice, the present invention will placed ahead of the user for pitching training. The direction of the top sensor 3 and the bottom sensor 4 is facing will be perpendicular to the direction of the user's stride during the pitching motion. The direction of the top sensor 3 will be parallel to the ground. The direction of the bottom sensor 4 will be directed towards the user at 45 degrees with respect to the direction of the top sensor 3. The direction that the top sensor 3 is able to sense vertically ranges from the space directly in front of it and fans towards the sky. The direction that the bottom sensor 4 is able to sense vertically ranges from the space directly in front of it and fans towards the ground. While the user is striding and performing the pitching action, the user will first stride forward with their lead leg with the upper body following forwards afterwards. In both the pitching and batting training, if the user strides forward with the proper mechanics and form, the bottom sensor 4 will activate before the top sensor 3. The present invention is designed to allow for the "drift" of the user as, the pitching mechanics or the hitting mechanics are being performed. To attain maximum power and velocity, the user must keep his/her weight back as the motion begins and then transfer his/her weight to the front side as the motion finishes. If the bottom sensor 4 activates before the top sensor 3 as the mechanic is being performed, the user will have kept his/her weight back sufficiently enough to approach maximum efficiency. The greater the time that lapses between the bottom sensor 4 and the top sensor 3 as they activate, the more likely it will be to reach maximum efficiency. It will provide instant feedback to the user or any instructor training the user. If the top sensor 3 activates before the bottom sensor 4 does or there is insufficient time between the two sounds and signals, maximum efficiency will never be achieved. If this occurs during the pitching mechanics, instructors call this "rushing." If this occurs on the hitting side, instructors call this "lunging". Both rushing and lunging are not acceptable forms and result in low efficiency hits and pitches.

Although the invention has been explained in relation to its preferred embodiment, it is to be understood that many other possible modifications and variations can be made without departing from the spirit and scope of the invention as hereinafter claimed.

What is claimed is:

1. A pitching and hitting training aid comprises, a mount case;

a mount pole;

a top sensor;

a bottom sensor;

a plurality of stakes;

the mount stand comprises of a base and a cover;

the base comprises a storage compartment, a pole port, and a plurality of eyelets;

the cover comprises of a pole port hole;

the top sensor comprises of a top protective casing, a top activation indicator and a top battery pack;

the bottom sensor comprises of a bottom protective casing, a bottom activation indicator and a bottom battery pack; and the mount pole comprises of a first segment collar, a second segment collar, a top segment, a bottom segment, a middle segment, a top sensor mount, and a bottom sensor mount.

2. The pitching and hitting training aid as claimed in claim 1 comprises, the top segment comprises a first top end and a first bottom end;

the middle segment comprises a second top end and a second bottom end;

the bottom segment comprises a third top end and a third bottom end;

the first bottom end comprises a top fastening means;

the second bottom end comprises a middle fastening means;

the third bottom end comprises a bottom fastening means;

the first segment collar comprises a top segment receiver; and the second segment collar comprises a middle segment receiver.

3. The pitching and hitting training aid as claimed in claim 2 comprises, the first segment collar being tube shaped;

the second segment collar being tube shaped;

the top fastening means being a selected from the group consisting of threads, snap-on lips, clamp, or latches;

the middle fastening means being selected from the group consisting of threads, snap-on lips, clamp, or latches;

the bottom fastening means being selected from the group consisting of threads, snap-on lips, clamp, or latches;

the first segment collar being secured on the middle segment adjacent to the second top end; and the second segment collar being secured on the bottom segment adjacent to the third top end.

4. The pitching and hitting training aid as claimed in claim 3 comprises, the first segment collar being extended past the second top end;

the second segment collar being extended past the third top end;

the top segment receiver being selected from the group consisting of female threads, snap-on indentation, clamp indentations, or latch indentations;

the middle segment receiver being selected from the group consisting of female threads, snap-on indentation, clamp indentations, or latch indentations;

the top segment being secured to the middle segment in linear relationship by means of fastening of the top fastening means into the top segment receiver of the first segment collar; and the middle segment being secured to the bottom segment in linear relationship by means of fastening of the middle fastening means into the middle segment receiver of the second segment collar.

5. The pitching and hitting training aid as claimed in claim 2 comprises, the top sensor mount being fastened to the middle segment adjacent to the first segment collar; and the bottom sensor mount being fastened to the bottom segment adjacent to the second segment collar.

6. The pitching and hitting training aid as claimed in claim 1 comprises, the top sensor being mounted onto the middle segment by the top sensor mount;

the bottom sensor being mounted onto the bottom segment by the bottom sensor mount;

the top protective casing being wrapped about the top sensor;

the bottom protective casing being wrapped about the bottom sensor;

the top sensor being powered by the top battery pack; and the bottom sensor being powered by the bottom battery pack.

7. The pitching and hitting training aid as claimed in claim 6 comprises, the top activation indicator comprising of a top audio alert and a top visual light; and the bottom activation indicator comprising of a bottom audio alert and a bottom visual light.

8. The pitching and hitting training aid as claimed in claim 1 comprises, the cover being jointly attached to the base;

the storage compartment being a recessed space in the base;

the plurality of eyelets protruding from the base;

the pole port being a recessed hole centered on the base;

the cover being positioned over the base; and the pole port hole being a hole leading to the pole port on the cover.

9. The pitching and hitting training aid as claimed in claim 8 comprises, the pole port having a fastening female part selected from the group consisting of threads or snap indentations; and the mount pole being secured to the mount case by fastening of the bottom fastening means into the pole port through the pole port hole.

10. A pitching and hitting training aid comprises, a mount case;

a mount pole;

a top sensor;

a bottom sensor;

a plurality of stakes;

the mount stand comprises of a base and a cover;

the base comprises a storage compartment, a pole port, and a plurality of eyelets;

the cover comprises of a pole port hole;

the top sensor comprises of a top protective casing, a top activation indicator and a top battery pack;

the bottom sensor comprises of a bottom protective casing, a bottom activation indicator and a bottom battery pack;

the mount pole comprises of a first segment collar, a second segment collar, a top segment, a bottom segment, a middle segment, a top sensor mount, and a bottom sensor mount;

the top sensor being mounted onto the middle segment by the top sensor mount;

the bottom sensor being mounted onto the bottom segment by the bottom sensor mount;

the top protective casing being wrapped about the top sensor;

the bottom protective casing being wrapped about the bottom sensor;

the top sensor being powered by the top battery pack;

the bottom sensor being powered by the bottom battery pack;

the top activation indicator comprising of a top audio alert and a top visual light;

the bottom activation indicator comprising of a bottom audio alert and a bottom visual light;

the top segment comprises a first top end and a first bottom end;

the middle segment comprises a second top end and a second bottom end; and the bottom segment comprises a third top end and a third bottom end.

11. The pitching and hitting training aid as claimed in claim 10 comprises, the first bottom end comprises a top fastening means;

the second bottom end comprises a middle fastening means;

the third bottom end comprises a bottom fastening means;

the first segment collar comprises a top segment receiver;

the second segment collar comprises a middle segment receiver;

the first segment collar being tube shaped;

the second segment collar being tube shaped;

the top fastening means being a selected from the group consisting of threads, snap-on lips, clamp, or latches;

the middle fastening means being selected from the group consisting of threads, snap-on lips, clamp, or latches;

the bottom fastening means being selected from the group consisting of threads, snap-on lips, clamp, or latches;

the first segment collar being secured on the middle segment adjacent to the second top end; and the second segment collar being secured on the bottom segment adjacent to the third top end.

12. The pitching and hitting training aid as claimed in claim 11 comprises, the first segment collar being extended past the second top end;

the second segment collar being extended past the third top end; and the top segment receiver being selected from the group consisting of female threads, snap-on indentation, clamp indentations, or latch indentations.

13. The pitching and hitting training aid as claimed in claim 12 comprises, the middle segment receiver being selected from the group consisting of female threads, snap-on indentation, clamp indentations, or latch indentations;

the top segment being secured to the middle segment in linear relationship by means of fastening of the top fastening means into the top segment receiver of the first segment collar; and the middle segment being secured to the bottom segment in linear relationship by means of fastening of the middle fastening means into the middle segment receiver of the second segment collar.

14. The pitching and hitting training aid as claimed in claim 11 comprises, the top sensor mount being fastened to the middle segment adjacent to the first segment collar; and the bottom sensor mount being fastened to the bottom segment adjacent to the second segment collar.

15. The pitching and hitting training aid as claimed in claim 10 comprises, the cover being jointly attached to the base;

the storage compartment being a recessed space in the base;

the plurality of eyelets protruding from the base;

the pole port being a recessed hole centered on the base;

the cover being positioned over the base;

the pole port hole being a hole leading to the pole port on the cover the pole port having a fastening female part selected from the group consisting of threads or snap indentations; and the mount pole being secured to the mount case by fastening of the bottom fastening means into the pole port through the pole port hole.

16. A pitching and hitting training aid comprises, a mount case;

a mount pole;

a top sensor;

a bottom sensor;

a plurality of stakes;

the mount stand comprises of a base and a cover;

the base comprises a storage compartment, a pole port, and a plurality of eyelets;

the cover comprises of a pole port hole;

the top sensor comprises of a top protective casing, a top activation indicator and a top battery pack;

the bottom sensor comprises of a bottom protective casing, a bottom activation indicator and a bottom battery pack;

the mount pole comprises of a first segment collar, a second segment collar, a top segment, a bottom segment, a middle segment, a top sensor mount, and a bottom sensor mount;

the top sensor being mounted onto the middle segment by the top sensor mount;

the bottom sensor being mounted onto the bottom segment by the bottom sensor mount;

the top protective casing being wrapped about the top sensor;

the bottom protective casing being wrapped about the bottom sensor;

the top sensor being powered by the top battery pack;

the bottom sensor being powered by the bottom battery pack;

the top activation indicator comprising of a top audio alert and a top visual light;

the bottom activation indicator comprising of a bottom audio alert and a bottom visual light;

the top segment comprises a first top end and a first bottom end;

the middle segment comprises a second top end and a second bottom end;

the bottom segment comprises a third top end and a third bottom end;

the first bottom end comprises a top fastening means;

the second bottom end comprises a middle fastening means;

the third bottom end comprises a bottom fastening means;

the first segment collar comprises a top segment receiver;

the second segment collar comprises a middle segment receiver;

the top sensor mount being fastened to the middle segment adjacent to the first segment collar; and the bottom sensor mount being fastened to the bottom segment adjacent to the second segment collar.

17. The pitching and hitting training aid as claimed in claim 16 comprises, the first segment collar being tube shaped;

the second segment collar being tube shaped;

the top fastening means being a selected from the group consisting of threads, snap-on lips, clamp, or latches;

the middle fastening means being selected from the group consisting of threads, snap-on lips, clamp, or latches;

the bottom fastening means being selected from the group consisting of threads, snap-on lips, clamp, or latches;

the first segment collar being secured on the middle segment adjacent to the second top end; and the second segment collar being secured on the bottom segment adjacent to the third top end.

18. The pitching and hitting training aid as claimed in claim 17 comprises, the first segment collar being extended past the second top end;

the second segment collar being extended past the third top end; and the top segment receiver being selected from the group consisting of female threads, snap-on indentation, clamp indentations, or latch indentations.

19. The pitching and hitting training aid as claimed in claim 18 comprises, the middle segment receiver being selected from the group consisting of female threads, snap-on indentation, clamp indentations, or latch indentations;

the top segment being secured to the middle segment in linear relationship by means of fastening of the top fastening means into the top segment receiver of the first segment collar; and the middle segment being secured to the bottom segment in linear relationship by means of fastening of the middle fastening means into the middle segment receiver of the second segment collar.

20. The pitching and hitting training aid as claimed in claim 16 comprises, the cover being jointly attached to the base;

the storage compartment being a recessed space in the base;

the plurality of eyelets protruding from the base;

the pole port being a recessed hole centered on the base;

the cover being positioned over the base;

the pole port hole being a hole leading to the pole port on the cover.

the pole port having a fastening female part selected from the group consisting of threads or snap indentations; and the mount pole being secured to the mount case by fastening of the bottom fastening means into the pole port through the pole port hole.

* * * * *